US010400665B2

(12) United States Patent
Martin

(10) Patent No.: US 10,400,665 B2
(45) Date of Patent: Sep. 3, 2019

(54) ASSEMBLY FOR AN AIR CIRCUIT OF A HEAT ENGINE

(71) Applicant: Valeo Systemes de Controle Moteur, Cergy Saint Christophe (FR)

(72) Inventor: Nicolas Martin, Maisons-Laffitte (FR)

(73) Assignee: Valeo Systemes de Controle Moteur, Cergy Saint Christophe (FR)

( * ) Notice: Subject to any disclaimer, the term of this patent is extended or adjusted under 35 U.S.C. 154(b) by 368 days.

(21) Appl. No.: 15/507,565

(22) PCT Filed: Aug. 26, 2015

(86) PCT No.: PCT/FR2015/052268

§ 371 (c)(1),
(2) Date: May 22, 2017

(87) PCT Pub. No.: WO2016/030628

PCT Pub. Date: Mar. 3, 2016

(65) Prior Publication Data

US 2017/0254258 A1 Sep. 7, 2017

(30) Foreign Application Priority Data

Aug. 28, 2014 (FR) ..... 14 58037

(51) Int. Cl.
*F02B 33/44* (2006.01)
*F02B 39/10* (2006.01)

(52) U.S. Cl.
CPC ..... *F02B 33/446* (2013.01); *F02B 39/10* (2013.01)

(58) Field of Classification Search
CPC ..... F02B 33/446; F02B 39/10
See application file for complete search history.

(56) References Cited

U.S. PATENT DOCUMENTS 1,031,245 A 7/1912 Chapin
4,350,135 A * 9/1982 Casey ..... F02B 33/36 123/564

(Continued)

FOREIGN PATENT DOCUMENTS

GB 285811 A 4/1928
GB 2129056 A 5/1984

(Continued)

OTHER PUBLICATIONS

International Search Report issued PCT/FR2015/052268, dated Dec. 16, 2015 (3 pages).

(Continued)

*Primary Examiner* — Jesse S Bogue
(74) *Attorney, Agent, or Firm* — Osha Liang LLP

(57) ABSTRACT

The invention relates to a fluid assembly (1) comprising: a first pipe (11), a second pipe (12) forming a bypass of a portion of the first pipe (11), comprising a compressor (15), and a switching system (10) for switching the fluid into either the second pipe (12) or said portion, having a first configuration allowing the fluid to circulate in the portion, and comprising a supporting member exerting a torque configured to keep the system (10) in the first configuration, and at least one area blocking the inlet or the outlet of the second pipe when the system (10) is in the first configuration, the system (10) being able to enter a second configuration allowing the fluid to circulate in the second pipe (12), the supporting member being such that the torque that it exerts on the system (10) drops when the system (10) passes from the first configuration to the second configuration.

6 Claims, 3 Drawing Sheets

(56) References Cited

U.S. PATENT DOCUMENTS

Figure 1:
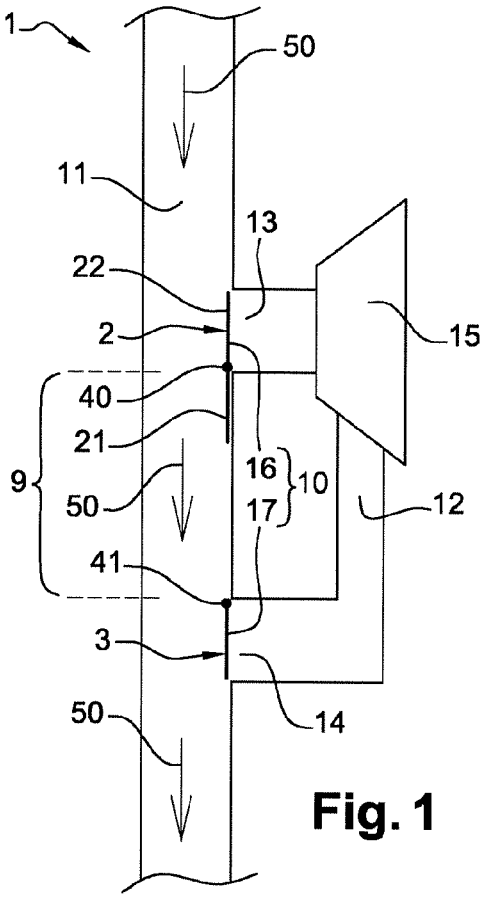

| | | | | |
|---|---|---|---|---|
| 4,434,775 | A | 3/1984 | Yoshimura et al. | |
| 5,022,375 | A * | 6/1991 | Goto | F02B 33/44 123/564 |
| 5,119,795 | A * | 6/1992 | Goto | F02B 29/0418 123/563 |
| 7,451,597 | B2 * | 11/2008 | Kojima | F02B 29/0418 60/605.1 |
| 9,534,532 | B2 * | 1/2017 | Eybergen | F02B 33/38 |
| 9,856,781 | B2 * | 1/2018 | Tsourapas | F02B 33/36 |

FOREIGN PATENT DOCUMENTS

| | | | |
|---|---|---|---|
| JP | S58-172426 | A | 10/1983 |
| WO | 93/05289 | A2 | 3/1993 |
| WO | 99/17008 | A1 | 4/1999 |

OTHER PUBLICATIONS

Written Opinion of the International Searching Authority issued in PCT/FR2015/052268, dated Dec. 16, 2015 (4 pages).

* cited by examiner

ASSEMBLY FOR AN AIR CIRCUIT OF A HEAT ENGINE

This invention relates to an assembly for an air circuit of a heat engine.

The invention applies in particular, but not exclusively, to the field of motor vehicles, the heat engine in this case allowing the vehicle to be propelled.

The assembly comprises a first pipe and a second pipe forming a bypass of a portion of the first pipe, the first and second pipes being capable of allowing fluid to flow through them. The assembly also comprises a fluid switching system allowing the distribution of the fluid to be varied between the portion of the first pipe and the second pipe.

It is known to provide the switching system with an actuator enabling the distribution of the fluid to be varied between the portion of the first pipe and the second pipe. Such an actuator, however, is costly and requires an adapted control law.

The invention aims to overcome this drawback while ensuring the desired distribution of fluid between the portion of the first pipe and the second pipe.

The invention achieves this, according to one of its aspects, with the aid of an assembly for an air circuit of a heat engine, comprising:

a first pipe capable of conveying fluid, a second pipe extending between an inlet in the first pipe and an outlet in the first pipe, so as to form a bypass of a portion of the first pipe, the second pipe comprising a pressure-variation source, and a system for switching fluid into one of either the second pipe or the said portion of the first pipe, the switching system having a first configuration allowing the fluid to circulate mainly in said portion of the first pipe, the switching system comprising:

- a holding device exerting a torque configured so as to bring or keep said switching system in the first configuration, and
- at least one area shutting off in this first configuration all or part of the inlet of the second pipe, and one area shutting off in this first configuration all or part of the outlet of the second pipe, the switching system being arranged to pass into a second configuration allowing the fluid to circulate mainly in the second pipe when the pressure variation generated in the second pipe by the source exceeds a predefined value, this pressure variation then exerting on the said area or areas of the switching system a torque enabling this passage into the second configuration, despite the torque exerted by the holding device, the holding device being such that the torque that it exerts on the switching system decreases when the switching system passes from the first into the second configuration.

The invention allows the total torque, consisting of the torque exerted by the pressure-variation source plus the torque exerted by the holding device, to be strictly positive when the switching system passes from the first into the second configuration. It is thus possible to compensate for the effect of the reduction in torque exerted by the source as the switching system passes from the first into the second configuration.

The switching system can be arranged so as to pass from the first configuration into the second configuration or from the second configuration into the first configuration solely by the action of the holding device and/or of the pressure-variation source.

The assembly can thus do away with an actuator dedicated to passing the switching system from the first into the second configuration.

The assembly benefits from the presence of the pressure-variation source in the second pipe to change the configuration of the switching system. Thanks to the area or areas shutting off in the first configuration at least part of the inlet of the second pipe and/or at least part of the outlet of the second pipe, this pressure variation is capable of generating a torque on the switching system, allowing the configuration thereof to be changed. The invention thus allows the pressure-variation source to play the role of an actuator causing the switching system to pass from the first into the second configuration, instead and in place of an actuator dedicated to this passage and comprising for example a shaft moving the switching system.

The pressure-variation source may be an electric supercharger arranged in the second pipe.

Such an electric supercharger can allow the heat engine to be rapidly supplied with compressed air when the heat engine operates at low speed or in the event of a sharp increase in load. This compressor then assists for example a turbocharger connected to a heat engine, in order to address the turbocompressor's long response time, the so-called "turbolag."

The holding device can be chosen to be compatible with the pressure-variation source, in order to enable the switching system to pass into the second configuration on the basis of the predefined pressure-variation value generated by the pressure-variation source.

The switching system can comprise at least one shutter that pivots when the system passes from the first to the second configuration and vice versa.

In one embodiment of the invention, the holding device can comprise a spring and a lever rigidly connected to the shutter, a lever through which the holding torque is exerted on the shutter, the spring comprising one fixed end and one movable end moving, in particular in translation in relation to the lever, when the shutter passes from the first into the second configuration, the movement allowing the lever arm to be varied.

The spring can be a compression screw.

The spring can be a tension spring.

The lever can comprise a housing in which a pin integral with the movable end of the spring can move in order to vary the lever arm.

The holding device can define a path guiding the movement of the pin in the housing so that the lever arm assumes a succession of predefined values when the switching system passes from the first into the second configuration.

The holding device can comprise a fixed cam and the path can be a cam track.

The lever can be rigidly connected to the shutter.

The path can define a curve in eccentric circles.

As a variation, the path can define a curve arranged so that the total torque exerted on the shutter, consisting of the torque exerted by the pressure-variation source plus the torque exerted by the holding device, is strictly positive when the switching system passes from the first into the second configuration.

Regardless of or in combination with that just stated above, the surface of the area or areas blocking at least partly the inlet and/or outlet of the second pipe can be chosen so as to allow the switching system to pass into the second configuration on the basis of the predefined pressure-variation value generated by the pressure-variation source.

In the first configuration of the switching system, the said area can shut off the entire inlet of the second pipe or the entire outlet of the said second pipe.

In this first configuration, all of the fluid can thus be routed through the portion of the first pipe, at the nearby flow-off points in the switching system.

In the second configuration of the switching system, all or part of the fluid can be routed along the second pipe. The word "mainly" used above must be deemed to mean both "more than half of the flow of fluid in the first pipe upstream of the inlet of the second pipe" and "all of the flow of fluid in the first pipe upstream of the inlet of the second pipe."

The first and the second pipe may form part of the induction system of the heat engine.

The electric supercharger can be arranged downstream of an outlet of an exhaust gas recirculation (EGR) loop.

The electric supercharger can be arranged upstream, downstream or parallel to the compressor of the turbocharger.

According to a first variation of the above-mentioned embodiment, the swiveling shutter of the switching system is arranged at the inlet of the second pipe.

According to this first variation, the inlet and outlet of the second pipe can be spaced apart in the first pipe.

According to this first variation, said shutter has, when the switching system is in the first configuration:

- a first part extending into the first pipe, beyond the inlet of said second pipe, and
- a second part shutting off all or part of the inlet of the second pipe and defining said area of the switching system, so that when a pressure variation corresponding to a pressure reduction at the inlet of the second pipe and generated by the source exceeds the predefined value, this variation in pressure causes the shutter to swivel into a position in which the first part shuts off all or part of said portion of the first pipe and in which the second part extends into the second pipe while enabling the fluid to circulate mainly in this second pipe, according to the second configuration of the switching system.

The shutter can then be drawn inwards into the second pipe due to the variation in pressure, changing the distribution of the fluid between the portion of the first pipe and the second pipe.

The section of the first part of the shutter may be smaller than the section of the second part of the shutter. This ratio between these sections can encourage the swiveling of the shutter to pass from the first configuration into the second configuration as soon as lower values of pressure variation are reached in the second pipe.

In the second configuration, the shutter can shut off the access to the portion of the first pipe, so that all of the fluid is directed towards the pressure-variation source.

According to a second variation of the above-mentioned embodiment, the swiveling shutter of the switching system is arranged at the outlet of the second pipe.

According to this second variation, the shutter has, when the switching system is in the first configuration, a part shutting off all or part of the outlet of the second pipe and defining said zone of the switching system, so that if a pressure variation corresponding to an overpressure at the outlet of the second pipe and generated by the source exceeds the predefined value, this pressure variation causes the shutter to swivel into a position in which said part shuts off all or part of the said portion of the first pipe, according to the second configuration of the switching system.

The shutter can then be pushed out of a position facing the outlet of the second pipe due to the pressure variation, changing the distribution of fluid between the portion of the first pipe and the second pipe.

The shutter, whatever the configuration of the switching system, can only extend into the first pipe: facing the outlet of the second pipe in the first configuration, and away from this outlet in the second configuration.

In the second configuration, the shutter can shut off the portion of the first pipe, so that the fluid is directed towards the pressure-variation source.

According to this second variation, the shutter can, in a plane perpendicular to its swivel axis, only extend on one side of said axis.

According to this first and this second variation, the switching system can thus comprise only one shutter to change the distribution of the fluid in the portion of the first pipe and in the second pipe.

According to a third variation of the above-mentioned embodiment, the switching system comprises:

- a first swiveling shutter arranged at the inlet of the second pipe, chiefly identical to the shutter according to the first embodiment of the invention, and
- a second swiveling shutter arranged at the outlet of the second pipe, chiefly identical to the shutter according to the second embodiment of the invention.

According to this third variation:

- the first shutter has, when the switching system is in the first configuration, a first part extending into the first pipe, beyond the inlet of said second pipe, and a second part shutting off all or part of the inlet of the second pipe and defining one of the said areas of the switching system;
- the second shutter having, when the switching system is in the first configuration, a part shutting off all or part of the outlet of the second pipe and defining another of said areas of the switching system, so that when a pressure variation corresponding to a pressure reduction at the inlet of the second pipe and to an overpressure at the outlet of the second pipe and generated by the source exceeds the predefined value, this pressure variation causes, according to the second configuration of the switching system:

- the pivoting of the first shutter into a position in which the first part of the first shutter shuts off all or part of said portion of the first pipe and in which the second part of the first shutter extends into the second pipe while allowing the fluid to circulate mainly in this second pipe, and
- the pivoting of the second shutter into a position in which said part of the second shutter shuts off all or part of said portion of the first pipe.

According to this third variation, the inlet and the outlet of the second pipe can be shut off entirely or partly by separate shutters when the switching system is in the first configuration, while two separate shutters placed in series can totally or partly shut off the portion of the first pipe when the switching system is in the second configuration.

According to this third variation, the holding device may comprise:

- a first spring and a first lever rigidly connected to the first shutter, a first lever by means of which the holding torque is exerted on the first shutter, the first spring comprising one fixed end and one movable end moving, particularly in translation in relation to said first lever, when the first shutter passes from the first into the second configuration, the movement allowing the lever arm to be varied, and a second spring and a second lever rigidly connected to the second shutter, a second lever by means of which the holding torque is exerted on the second shutter, the second spring comprising one fixed end and one movable end moving, particularly in translation in relation to said second lever, when the second shutter passes from the first into the second configuration, the movement allowing the lever arm to be varied.

In this way, the torque exerted by the holding device on both the first and second shutter can decrease as the switching system passes from the first to the second configuration.

According to a fourth variation of the above-mentioned embodiment, the inlet and the outlet of the second pipe are arranged adjacent in the first pipe, and the pivoting shutter of the switching system is arranged both at said inlet and said outlet.

The inlet and outlet of the second pipe can be formed by openings made along a straight portion of the first pipe.

According to this fourth variation, a single shutter replaces the first and second shutter of the third variation.

According to this fourth variation, said shutter has, when the switching system is in the first configuration:

a second part shutting off all or part of said inlet and forming one of said areas of the switching system, and a first part shutting off all or part of said outlet and forming another of said areas of the switching system, so that, when a variation in pressure corresponding to an overpressure at the outlet of the second pipe and a pressure reduction at the inlet of the second pipe and generated by the source exceeds the predefined value, this pressure variation causes the shutter to swivel into a position in which the first part shuts off all or part of said portion of the first pipe and in which the second part extends into the second pipe while allowing the fluid to circulate mainly in this second pipe, according to the second configuration of the switching system.

The position of this shutter encourages its pivoting since the second part is drawn into the second pipe as a result of the pressure reduction at the inlet thereof while the first part is pushed out of a position facing the outlet of the second pipe due to the overpressure prevailing there.

The pivot axis of the shutter can separate the first part from the second part of the shutter.

The ratio between the section of the first part of the shutter and the section of the second part of the shutter may be greater than one, such a ratio encouraging the shutter to pivot as soon as low pressure-variation values are reached in the second pipe.

In all of the above circumstances, the fluid can be a gas, such as air, re-circulated exhaust gas from the engine's exhaust, or a mixture of air and re-circulated exhaust gas.

In all of the above circumstances, the electric supercharger can comprise a variable-reluctance motor having, for example, a power rating of between 1 and 10 kW, for example 5.5 kW, for a rotation speed of 70,000 rpm.

As a variation, the electric supercharger can comprise a permanent magnet motor.

The assembly is, for example, incorporated into a motor vehicle.

The invention also concerns an assembly for the regulation of fluid in a heat engine, comprising:

at least one pipe capable of conveying the fluid;

at least one shutter arranged in a pipe, the shutter being arranged so as to pass between the first configuration and the second configuration, and a holding device exercising on said shutter a torque configured so as to return or hold the shutter in the first configuration, the holding device being such that the torque that it exerts on the shutter decreases when the shutter passes from the first into the second configuration.

In the first configuration, the assembly can be arranged so that the shutter defines a maximum flow area for the fluid in the pipe.

In the second configuration, the assembly can be arranged so that the shutter defines a minimum flow area for the fluid in the pipe.

As a variation, in the first configuration, the assembly can be arranged so that the shutter defines a minimum flow area for the fluid in the pipe.

In the second configuration, the assembly can be arranged so that the shutter defines a maximum flow area for the fluid in the pipe.

In one or the other of the above-mentioned variations, the assembly can comprise a pressure-variation source arranged to exert on the shutter a torque configured so as to make the shutter pass into the second configuration when the pressure variation generated by the source exceeds a predefined value, despite the torque exerted by the holding device.

All of the preceding characteristics of the invention apply separately or in combination with this other aspect of the invention.

Figure 2:
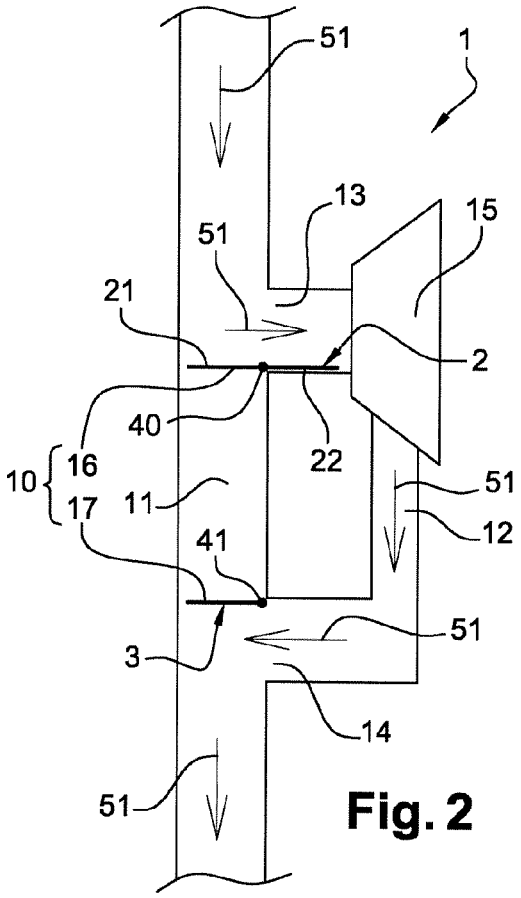
Figure 3:
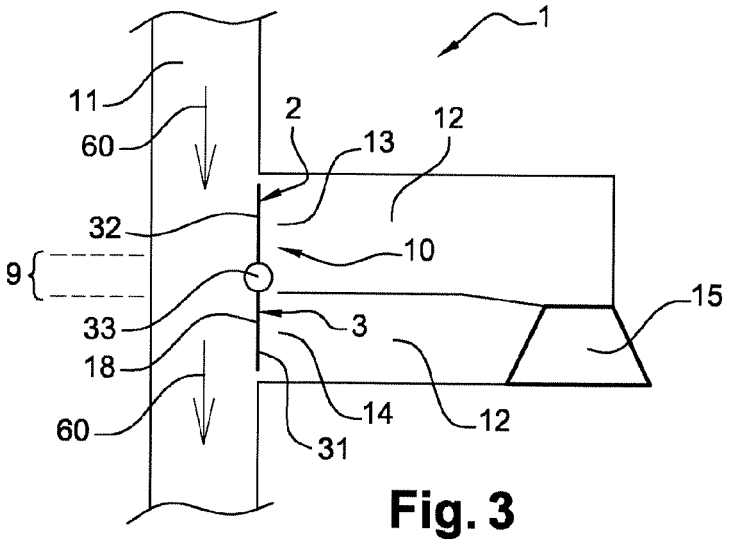
Figure 4:
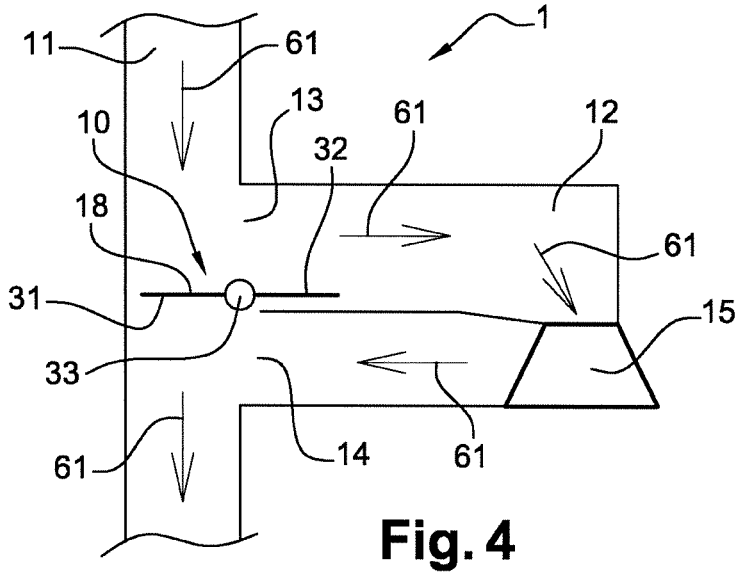
Figure 7:
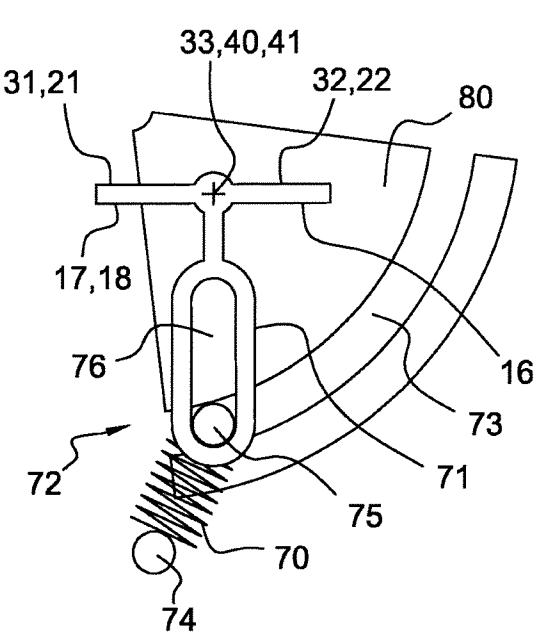
Figure 6:
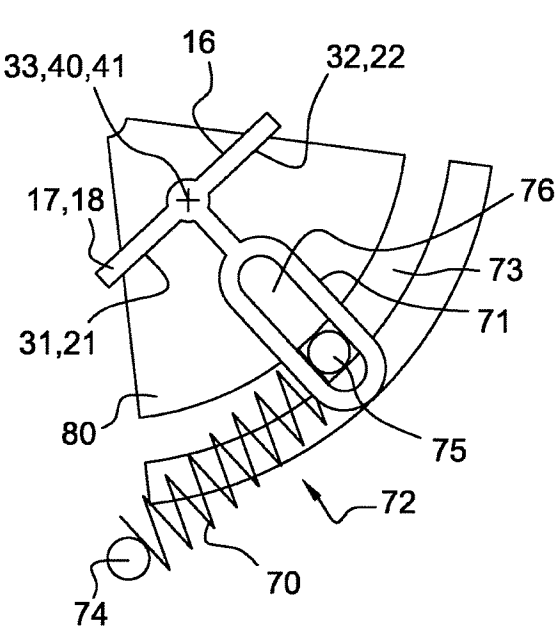
Figure 5:
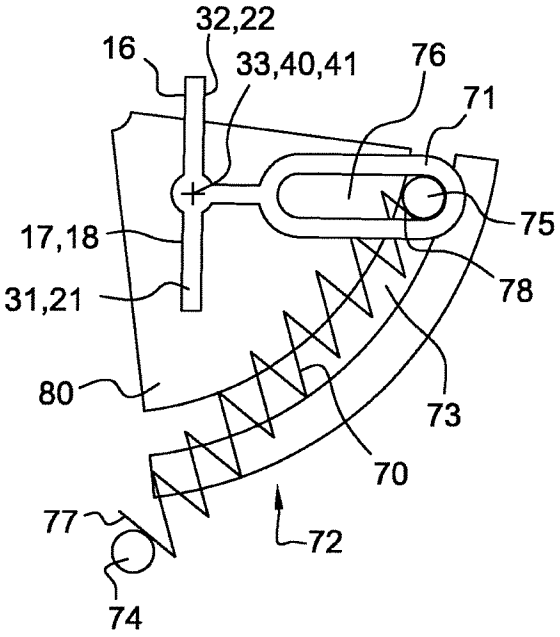

A better understanding of the invention will emerge from the following description of non-limiting examples of embodiments thereof with reference to the accompanying drawings, in which:

FIGS. 1 and 2 are schematic representations of an example of an assembly according to the invention, in the first and in the second configuration of the switching system respectively;

FIGS. 3 and 4 are schematic representations of another example of the assembly according to the invention, in the first and in the second configuration of the switching system respectively; and FIGS. 5 to 7 are schematic representations of an example of a holding device according to the invention, of at least one of the shutters of the switching system in FIGS. 1 and 2 or of the shutter of the switching system in FIGS. 3 and 4.

FIG. 1 shows an example of an assembly 1 for an air circuit of a heat engine. This concerns, for example, a heat engine of a vehicle, operating for example on petrol or diesel. The assembly 1 in the example forms part of an induction system of the heat engine. It is for example arranged downstream of the outlet in the induction system of an exhaust gas recirculation (EGR) loop.

The assembly 1 can also be connected to a mechanical compressor forming part of a turbocharger and not shown in the figures.

The assembly 1 comprises:

a first pipe 11 capable of conveying fluid, a second pipe 12 extending between an inlet 13 in the first pipe 11 and an outlet 14 in the first pipe 11.

As shown in FIG. 1, the second pipe thus forms a bypass of a portion 9 of the first pipe 11. Vice-versa, the portion 9 of the first pipe allows the second pipe 12 to be bypassed.

The second pipe 12 comprises an electric supercharger 15 forming a pressure-variation source. This electric supercharger 15 allows the turbocharger to be assisted particularly at low speed or in the event of a sharp increase in load. This electric supercharger 15 comprises in the example in question a variable reluctance motor.

The first pipe 11 comprises in the example in question a switching system 10 that consists of:

a pivoting shutter 16 arranged at the inlet 13 of the second pipe 12, and a pivoting shutter 17 arranged at the outlet 14 of the second pipe 12.

When the shutters 16, 17 are in the position shown in FIG. 1, the switching system 10 is in a configuration hereinafter called the "first configuration."

The shutter 16 comprises in the example shown in FIGS. 1 and 2 a first part 21 and a second part 22 connected by a pivot axis 40. This pivot axis 40 is located substantially at the junction between the inlet 13 of the second pipe 12 and the first pipe 11, extending facing said inlet 13. In the first configuration of the switching system 10, the first part 21 extends into the first pipe 11. The first part 21 extends for example parallel to the axis along which the first pipe extends at the inlet 13, so that the shut-off of said first pipe by the first part 21 is reduced when the switching system 10 is in the first configuration.

The first part 21 also extends beyond the second pipe 12 when the second part 22 forms an area 2 of the switching system 10 shutting off, in the first configuration, the inlet 13 of the second pipe 12. The second part 22 extends for example in this first configuration facing the inlet 13 of the second pipe 12 while remaining in the first pipe 11.

In the example in question, the shutter 17 comprises a pivot axis 41. As can be seen in FIG. 1, the shutter 17 only extends, when seen in a plane perpendicular to said pivot axis 41, on one side of said axis 41. The pivot axis is located substantially at the junction between the outlet 14 of the second pipe 12 and the first pipe 11, facing this outlet 14.

In this example, the shutter 17 forms an area 3 of the switching system 10 shutting off in the first configuration the outlet 14 of the second pipe 12. The shutter 17 is for example facing said outlet 14 while extending into the first pipe 11.

In the first configuration of the switching system 10, the fluid flowing through the first pipe 11 upstream of the second pipe 12 flows mainly in the portion 9 of the first pipe 11 bypassing the second pipe 12.

The path thus followed by the fluid is shown by the arrows 50. The word "mainly" used above must be deemed to mean "more than half of the flow of fluid in the first pipe 11 upstream of the inlet 13 of the second pipe 12."

If flow-off areas exist at each of the shutters 16, 17 when the switching system 1 is in the first configuration, part of the fluid can thus be routed along the second pipe 12.

FIG. 2 shows the assembly of FIG. 1 in a second configuration. In this second configuration, the first part 21 of the shutter 16 shuts off the portion 9 of the first pipe 11 and the second part 22 of the shutter 16 extends into the second pipe 12 without shutting it off. Still in this configuration, the shutter 17 shuts off portion 9 of the first pipe 11. In this second configuration, portion 9 of the first pipe is thus doubly shut off, on the one hand by the shutter 16 near the intake 13 of the second pipe 12, and on the other hand by the shutter 17 near the outlet 14 of the second pipe 12.

In this second configuration, the fluid flows mainly through the second pipe 12, the first pipe 11 having fluid flow through it only outside portion 9. Thus, the fluid is diverted from a portion of the path that it was routed through in FIG. 1 and so flows along the path shown by the arrows 51.

Each shutter 16, 17 is held or brought into position, as shown in FIG. 1, by a holding device 72 shown in FIGS. 5 to 7 and described below.

As will now be described, the invention allows the change in configuration of the switching system 10 from the first configuration described above with reference to FIG. 1 to the second configuration described above with reference to FIG. 2. The passage from the first to the second configuration is achieved without recourse to a dedicated actuator to pivot the shutters 16 and 17, in particular without recourse to an electric, pneumatic or electromagnetic actuator.

The assembly 1 passes from the first configuration into the second configuration when the electric supercharger 15 generates a pressure variation exceeding a predefined value to supply compressed air to the heat engine. This pressure variation corresponds in this example to a pressure reduction at the inlet 13 of the second pipe 12 and an overpressure at the outlet 14 of the second pipe 12.

Due to this pressure variation, a torque is exerted on each shutter 16, 17 through areas 2, 3 thereof, these areas 2, 3 extending facing the second pipe when the switching system is in the first configuration.

When the torque exerted on each shutter 16 of 17 due to the overpressure generated by the electric supercharger 15 becomes greater than a predefined value which in the example described is greater than the return torque exerted on said shutter by the corresponding holding device 72, the shutter pivots so that the switching system 10 assumes the second configuration.

The electric supercharger 15 thus plays the role of an actuator causing the shutters 16 and 17 to pass from the first to the second configuration.

When the pressure variation generated by the electric supercharger 15 exerts on each shutter 16, 17 a torque that is less than the return torque exerted by the corresponding holding device 72, the shutters 16 and 17 are returned to the position of the first configuration.

FIG. 3 shows another example of the assembly 1 different from that just described with reference to FIGS. 1 and 2 due to the fact that:

the inlet 13 and the outlet 14 of the second pipe 12 are arranged adjacent to one another in the first pipe 11 so that the portion 9 is smaller, and the switching system 10 comprises only one pivoting shutter 18 arranged both at the inlet 13 and the outlet 14 of the second pipe 12.

When the shutter 18 is in the position shown in FIG. 3, the switching system 10 is in the first configuration.

The shutter 18 comprises in the example shown in FIG. 3 a first part 31 and a second part 32 connected by a pivot axis 33. This pivot axis 33 is located substantially at the junction between the inlet 13 and the outlet 14 of the second pipe 12, facing the inlet 13.

In the first configuration of the switching system 10, the first part 31 and the second part 32 extend into the first pipe 11. These first 31 and second 32 parts extend for example parallel to the axis along which the first pipe 11 extends at the inlet 13 and outlet 14 of the second pipe 12, so that less of the first pipe 11 is shut off by these first 31 and second 32 parts.

The first part 31 forms the area 3 of the switching system 10 shutting off the outlet 14 of the second pipe 12 while the second part 32 forms in this example the area 2 of the switching system 10 shutting off the inlet 13 of the second pipe 12 when the switching system 10 is in the first configuration.

In the first configuration of the switching system 10, the fluid flowing in the first pipe 11 upstream of the second pipe 12 flows mainly in the portion 9 of the first pipe 11 bypassing the second pipe 12.

The path then travelled by the fluid is represented by the arrows 60.

FIG. 4 shows the assembly 1 of FIG. 3 in a second configuration. In this second configuration, the first part 31 of the shutter 18 shuts off the portion 9 of the first pipe 11 and the second part 32 of the shutter 18 extends into the second pipe 12 without shutting it off.

In this second configuration, the fluid flows mainly through the second pipe 12, with no fluid passing through the first pipe 11 except outside portion 9. Thus, the fluid is diverted from a portion of the path that it was routed through in FIG. 1 and so flows along the path shown by the arrows 61.

The shutter 18 is held or brought into position as shown in FIG. 3 by a holding device 72 shown in FIGS. 5 to 7 described below.

As described with reference to FIGS. 1 and 2, the invention allows the configuration of the switching system 10 to change from the first configuration described above with reference to FIG. 3 to the second configuration described above with reference to FIG. 4. The assembly 1 passes from the first configuration into the second configuration when the electric supercharger 15 generates a pressure variation in order to supply compressed air to the heat engine. This pressure variation corresponds in this example to a pressure reduction at the inlet 13 of the second pipe 12 and to an overpressure at the outlet 14 of the second pipe 12.

Due to this pressure variation, a torque is exerted on the shutter 18 through areas 2, 3 thereof extending facing the second pipe when the switching system is in the first configuration. This torque allows, as described above, the switching system 10 to pass from the first into the second configuration.

FIGS. 5 to 7 show an example of a holding device 72 of the shutter 18 of the switching system of FIGS. 3 and 4, the shutter 18 being in the first configuration, in an intermediate configuration between the first and the second configuration and in the second configuration respectively.

Although described in relation to assembly 1 in FIGS. 3 and 4, the holding device 72 in FIGS. 5 to 7 can be adapted to any of shutters 16, 17 and 18 of the assemblies in FIGS. 1 and 2.

In the example described, the holding device 72 comprises a compression spring 70 and a lever 71 rigidly connected to the shutter 18.

The holding device 72 exerts a holding torque on the shutter 18 by means of the lever 71.

In this example, the compression spring 70 comprises one fixed end 77 connected to a fixed pin 74 and one movable end 78 connected to a movable pin 75. The fixed pin 74 allows the fixed end 77 to perform a rotational movement about it but holds this fixed end 77 so that no translational movement is possible.

As described below, the movable pin 75 is movable in translation, in a radial direction in relation to the pivot axis 33, 40, 41 of rotation of the shutter 17, 18. Thus, on moving, it allows the movable end 78 to perform a translational movement in relation to the fixed pin 74 and a rotational movement about the movable pin 75.

In this example, the lever 71 comprises a housing formed by an oblong hole 76 in which a pin 75 integral with the movable end of the spring can move in order to vary the lever arm.

In the example described, the holding device 72 comprises a fixed cam 80. This cam 80 comprises a cam track 73 into which projects the movable pin 75. In this example, the cam track 73 defines a curve in eccentric circles in relation to the pivot axis 33, 40, 41.

Thus, the cam track 73 guides the movement of the movable pin 75 in the housing 76 so that the lever arm assumes a succession of predefined values, when the switching system passes from the first into the second configuration. Thus, the movable pin 75 is movable in a composite motion due to the movement thereof in the cam track 73 and in the housing 76.

The lever is 71 is moved when the switching system passes from the first into the second configuration.

Although the holding device 72 in FIGS. 5 to 7 is connected to the shutters 16 and 18 in FIGS. 3 and 4, i.e. to shutters 16, 18 comprising a first part 21, 31 and a second part 22, 32 joined by a pivot axis 33, 40, it may be adapted to the shutter 17 in FIGS. 1 and 2, i.e. to a shutter 17 extending, when seen in a plane perpendicular to its pivot axis 41, on only one side of this axis 41.

The holding device 72 exerts a holding torque on the shutter 18. This holding torque is formed by the effort exerted by the spring 70 and by the lever arm. When the switching system 10 passes from the first into the second configuration, the effort exerted by the spring 70 increases because the spring is compressed. Furthermore, the cam track 73 is configured so that the successive positions of the movable pin 75 act on the lever arm. Thus, the lever arm shortens as the passage of the switching system 10 from the first into the second configuration progresses. The holding device 72 is thus configured so that the holding torque reduces when the switching system 10 passes from the first into the second configuration.

When the switching system passes from the first configuration into the second configuration, the first part 31 of the shutter 18 gradually opens the outlet 14 of the second pipe 12 and the second part 32 of the shutter 18 gradually opens the inlet 13 of the second pipe 12. Consequently, the torque exerted on each part 31, 32 of the shutter 18 by the electric supercharger 15 decreases when the switching system passes from the first configuration into the second configuration.

This reduction occurs even if the compressor 15 is in steady state operation when the switching system passes from the first configuration into the second configuration.

Thus, the total torque exerted on the shutter 18, consisting of the torque generated by the compressor 15 to which is added the torque generated by the holding device 72, stays strictly positive when the switching system passes from the first configuration into the second configuration.

The expression "comprising a" must be deemed to be synonymous with the expression "comprising at least one," unless stated otherwise.

The invention claimed is:

1. An assembly for an air circuit of a heat engine, comprising:

a first pipe capable of conveying fluid;

a second pipe extending between an inlet in the first pipe and an outlet in the first pipe, to form a bypass of a portion of the first pipe, the second pipe comprising a pressure-variation source; and a switching system for switching fluid into one of either the second pipe or the portion of the first pipe, the switching system having a first configuration allowing the fluid to circulate mainly in said portion of the first pipe, the switching system comprising:

a holding device exerting a torque configured so as to bring or keep said switching system in the first configuration, and at least one first area shutting off in the first configuration at least a portion of the inlet of the second pipe, and one second area shutting off in the first configuration at least a portion of the outlet of the second pipe, the switching system being arranged to pass into a second configuration allowing the fluid to circulate mainly in the second pipe when the pressure variation generated in the second pipe by the source exceeds a predefined value, wherein the pressure variation exerts a torque on the at least one of the first and second areas of the switching system, enabling passage into the second configuration, despite a torque exerted by the holding device, wherein the torque exerted by the holding device on the switching system decreases when the switching system passes from the first into the second configuration.

2. The assembly according to claim 1, having no actuator dedicated to passing the switching system from the first into the second configuration.

3. The assembly according to claim 1, the pressure-variation source being an electric supercharger arranged in the second pipe.

4. The assembly according to claim 1, the switching system comprising at least one pivoting shutter, and the holding device comprising a spring and a lever rigidly connected to the pivoting shutter, through which the holding torque is exerted on the shutter, the spring comprising one fixed end and one movable end moving, in translation in relation to the lever, when the switching system passes from the first into the second configuration, the movement allowing a lever arm of the lever to be varied.

5. The assembly according to claim 4, the lever comprising a housing in which a movable pin integral with the movable end of the spring moves in order to vary the lever arm.

6. The assembly according to claim 5, the holding device defining a path guiding the movement of the movable pin in the housing so that the lever arm assumes a succession of predefined values when the switching system passes form the first into the second configuration.

* * * * *